US006729642B2

(12) United States Patent
Gouzes et al.

(10) Patent No.: US 6,729,642 B2
(45) Date of Patent: May 4, 2004

(54) BINDINGS FOR SKIBOOTS FOR SNOWBOARDS

(75) Inventors: Philippe Gouzes, Voiron (FR); Olivier Haupt, Grenoble (FR)

(73) Assignee: Skis Rossignol SA, Voiron (FR)

( * ) Notice: Subject to any disclaimer, the term of this patent is extended or adjusted under 35 U.S.C. 154(b) by 0 days.

(21) Appl. No.: 09/972,455

(22) Filed: Oct. 5, 2001

(65) Prior Publication Data

US 2002/0070530 A1 Jun. 13, 2002

(30) Foreign Application Priority Data

Oct. 5, 2000 (FR) ..... 00 12703

(51) Int. Cl.[7] ..... A63C 9/00

(52) U.S. Cl. ..... 280/623; 280/607; 280/11.36; 280/14.21

(58) Field of Search ..... 280/618, 617, 280/623, 626, 624, 628, 631, 632, 633, 634, 809, 14.21, 14.22, 11.36; 36/118.2, 118.7, 118.8, 117.3, 117.1

(56) References Cited

U.S. PATENT DOCUMENTS

| | | | | | |
|---|---|---|---|---|---|
| 4,379,370 | A | * | 4/1983 | Balbinot | 36/118.8 |
| 4,979,760 | A | * | 12/1990 | Derrah | 280/607 |
| 5,363,572 | A | * | 11/1994 | Marega et al. | 36/118.7 |
| 5,727,797 | A | | 3/1998 | Bowles | 280/14.2 |
| 5,894,684 | A | * | 4/1999 | Sand et al. | 36/117.1 |
| 5,975,557 | A | * | 11/1999 | Snoke et al. | 280/624 |
| 6,027,136 | A | * | 2/2000 | Phillips | 280/618 |
| 6,116,635 | A | * | 9/2000 | Rigal | 280/618 |
| 6,231,057 | B1 | * | 5/2001 | Reuss et al. | 280/14.21 |
| 6,283,482 | B1 | * | 9/2001 | Coulter | 280/14.22 |
| 6,283,495 | B1 | * | 9/2001 | Phillips | 280/618 |
| 6,360,454 | B1 | * | 3/2002 | Dachgruber et al. | 36/54 |
| 6,364,323 | B1 | * | 4/2002 | Coulter | 280/14.22 |
| 6,390,492 | B1 | * | 5/2002 | Bumgarner et al. | 280/607 |
| 6,402,164 | B1 | * | 6/2002 | Gonthier | 280/14.22 |
| 6,406,040 | B1 | * | 6/2002 | Thorne | 280/14.21 |
| 6,543,793 | B1 | * | 4/2003 | Reuss et al. | 280/11.36 |

FOREIGN PATENT DOCUMENTS

| | | |
|---|---|---|
| DE | 4416023 | 10/1995 |
| DE | 19802304 | 7/1999 |

* cited by examiner

*Primary Examiner*—Brian L. Johnson
*Assistant Examiner*—Bridget Avery
(74) *Attorney, Agent, or Firm*—Fay, Sharpe, Fagan, Minnich & McKee, LLP

(57) ABSTRACT

A ski boot binding for snowboards includes a base (4) to which a back piece (10) is pivotally mounted. The back piece (10) extends upward from the base and supports the user's ankle. The degree to which the back piece flexes affects an amount of support which it provides to the user's ankle. A reinforcement (22) is mounted on a central part of a rear face (19) of the back piece. The reinforcement is adjustably mounted for vertical movement relative to the back piece to adjust the flexibility of the back piece, hence the amount of rearward ankle support.

18 Claims, 10 Drawing Sheets

R 2

19
10
20b
16
7a
17
20a
22
L3
L1
4
5
32
33
7b
8
6
21
9

BINDINGS FOR SKIBOOTS FOR SNOWBOARDS

BACKGROUND OF THE INVENTION

The present invention concerns a ski binding particularly adapted for snowboards.

For the practice of snowboarding, the user utilizes ski boots with relatively flexible bindings. Known bindings include a base plate and a back piece for receiving the aforementioned ski boot. Moreover, the boots are supported on the base plate by adjustable bindings.

As is known, the back piece is connected to articulate toward the front of the base plate but is blocked against pivoting toward the rear by a system of abutments that assure the snowboarder of sufficiently flexible back support for optimal snowboarding.

Actually, a known back support element does not permit the user to conduct an optimal snowboarding run because the binding is not adaptable for some commonly used ski boots.

The present invention is an improvement that allows the utilization of a rear attachment that is ideal for any style of commonly used ski boot.

SUMMARY OF THE INVENTION

Thus, the binding of the ski boot on the snowboard according to the present invention is of a type contemplating a base plate on which a rear attachment piece is mounted which extends upward and is designed to serve as a rear support for the ankle of the ski boot. The rear support includes on a central part a reinforcement that is vertically adjustable relative to the ankle support. The ankle support is advantageously mounted to pivot on the base around a transverse axis.

According to a complementary characteristic, the reinforcement is an independent piece from the ankle support; its length is larger than its width while the aforementioned length is half as large as a height of the central part of the ankle support that is flexibly placed near the rear of the ski boot.

According to another characteristic, the means for adjusting the vertical position of the reinforcement includes at least a screw/release system for mounting the reinforcement on the rear support piece and to a lesser degree an oblong hole or opening for the adjustable displacement of the vertical reinforcement along the back piece or ankle support.

According to a preferred embodiment, the rear ankle support piece includes along a plane of vertical symmetry two open slots arranged one above the other while the vertical reinforcement includes two holes again arranged one above the other, each of the holes being designed to receive a connection member with a flange to prevent rotation.

In addition, the guide means are designed for vertical displacement of the reinforcement relative to the back ankle support as well as means for indexing the position of the reinforcement, which means includes a succession of cooperating teeth or ridges.

According to another characteristic, the lower end of the reinforcement includes a stop adapted to come to rest against an upper edge of the back arch independent of the base plate.

According to another characteristic of the invention, the back ankle support includes on a central portion of its back, a reinforcement that is movable from near the bottom to the top and vice versa. Moving the reinforcement piece improves the rigidity and the prevention of bending or flexation of the back of the back ankle support in order to assure the user better ankle support when practicing snowboarding, enabling him to have better control of his trajectory.

It is to be understood that the reinforcement is a complementary piece which improves the rigidity and limits flexing or bending of the back piece thereby allowing the user to insure better ankle support when practicing snowboarding and adjusting its position to enable the user to personalize this thus ensuring that the user has better control of his trajectory.

Other characteristics and advantages of the invention will become apparent in the following description along with the appended drawings which are given by way of example only and are not limiting.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 3 is a rear perspective view of the binding without the ski boot.

FIGS. 4 and 5 are side and rear views, respectively, of the back piece equipped with the adjustable reinforcement.

FIG. 6 is a cross-sectional view through section A—A of FIGS. 4 and 5.

FIG. 7 is a cross-sectional view through section B—B of FIGS. 4 and 5.

FIG. 8 is a side, expanded view of the back piece and the reinforcement.

FIG. 9 is a rear view of the back piece alone.

FIG. 10 is a front view of the back piece alone.

FIGS. 11–14 are illustrations of the reinforcement alone.

FIG. 11 is a rear view.

FIG. 12 is a front view.

FIG. 13 is a cross-sectional view through section C—C of FIG. 11.

FIG. 14 is a cross-sectional view through section D—D of FIG. 11.

FIGS. 15, 16, 17, 18, 19, and 20 are rear views and corresponding

DETAILED DESCRIPTION OF THE PREFERRED EMBODIMENTS

Figure 1:
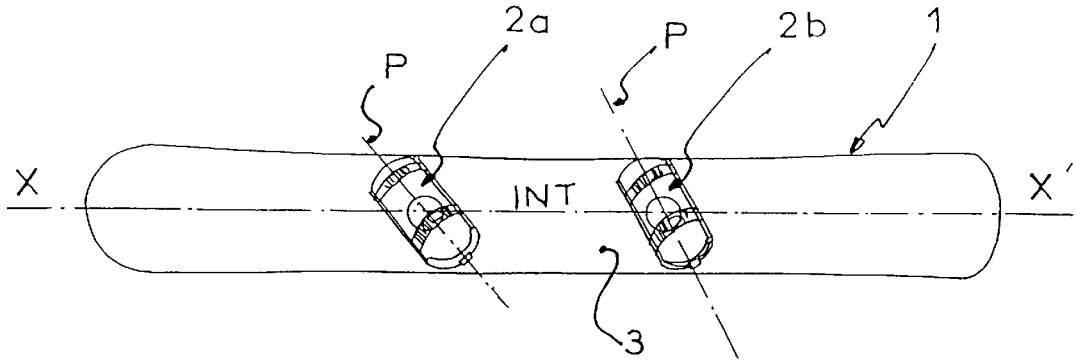
FIG. 1 is a top view of a snowboard with two bindings for ski boots of the user.
Figure 2:
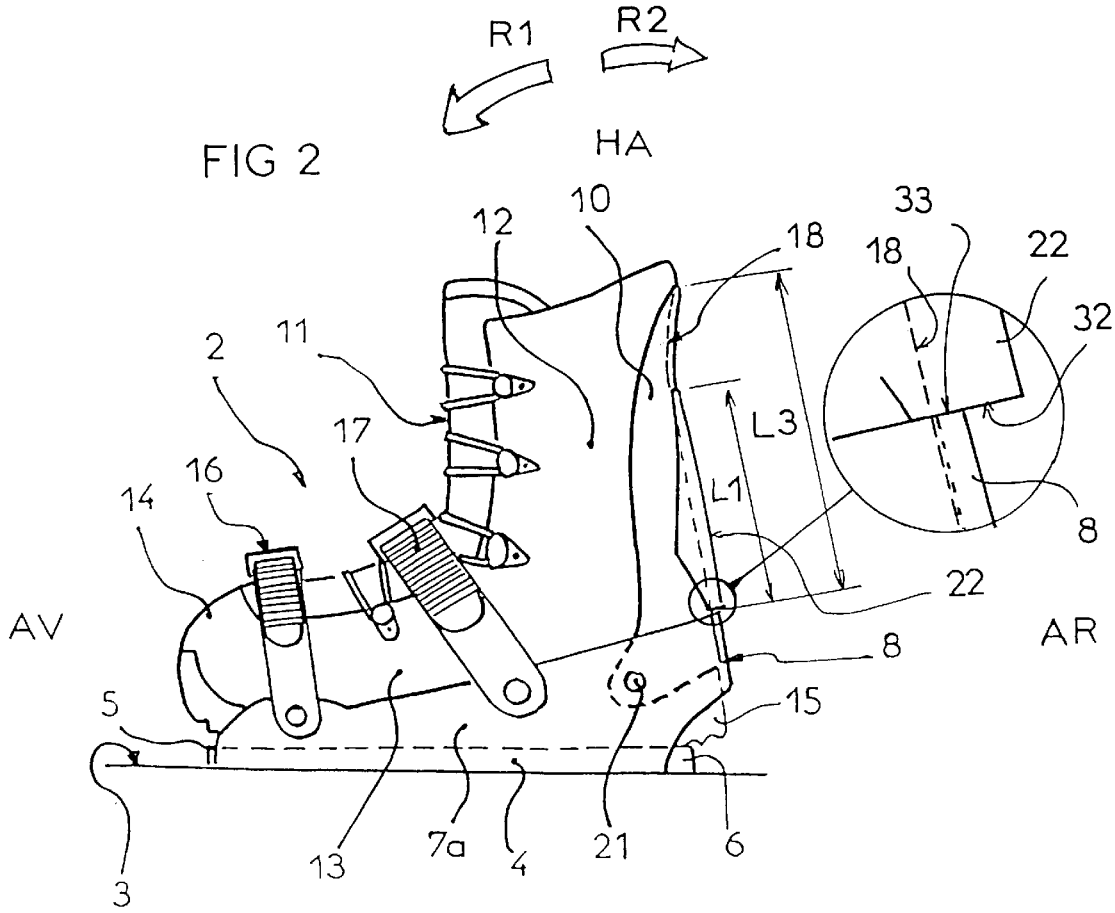
FIG. 2 is a side view of the binding according to the invention in combination with a ski boot.
Figure 3:
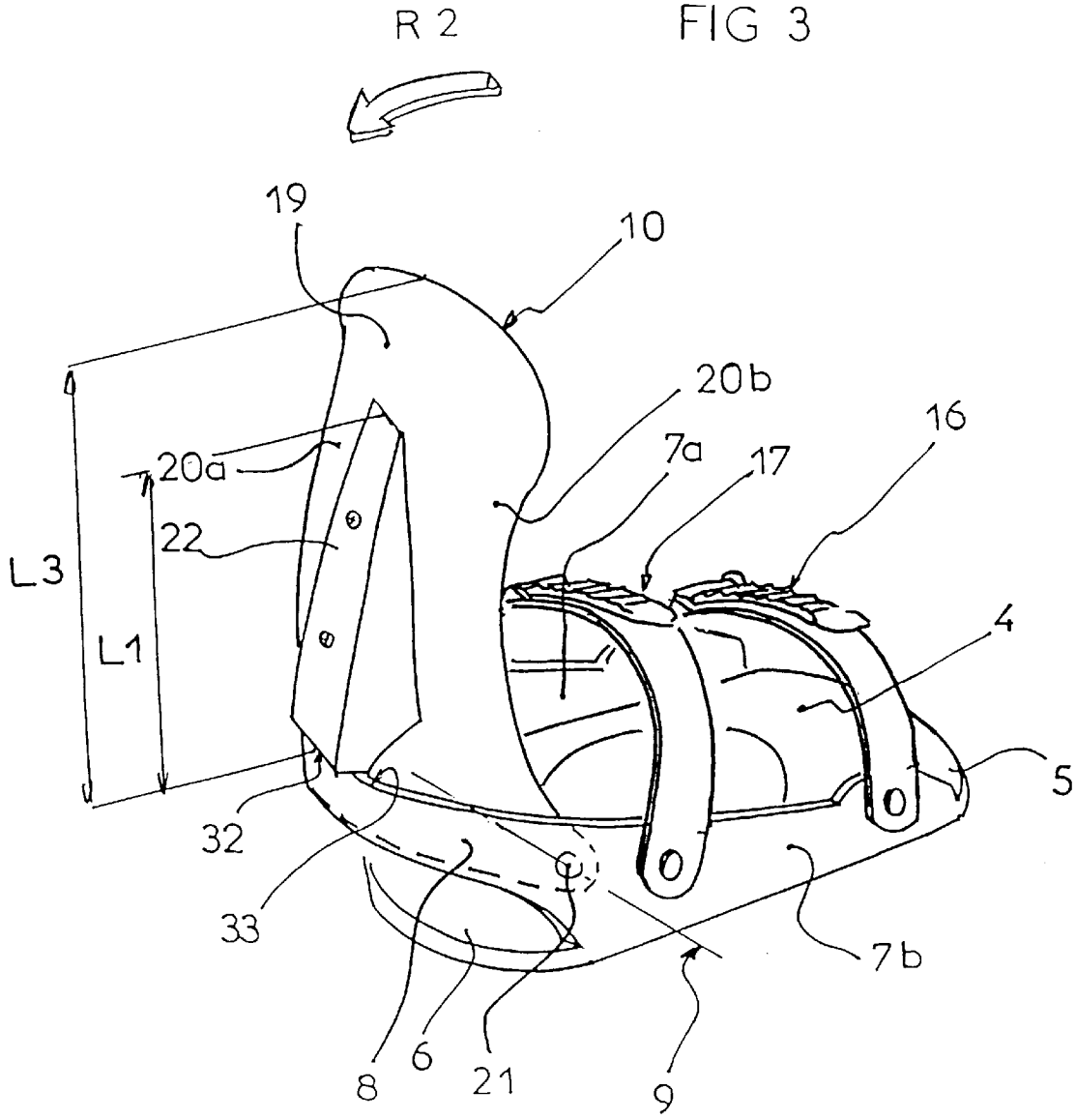
FIGS. 3–14 are views illustrative of a first embodiment of the invention.
Figure 4:
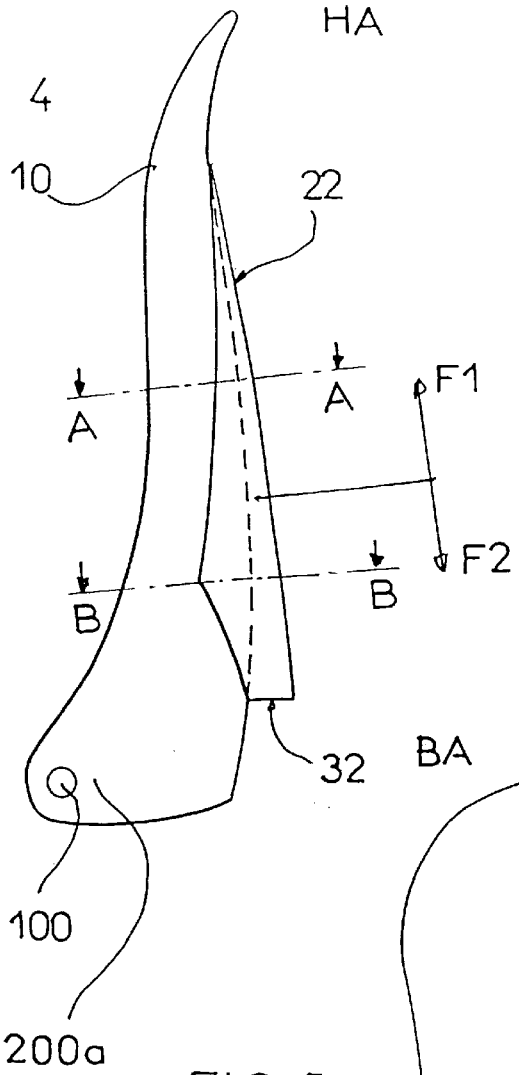
Figure 5:
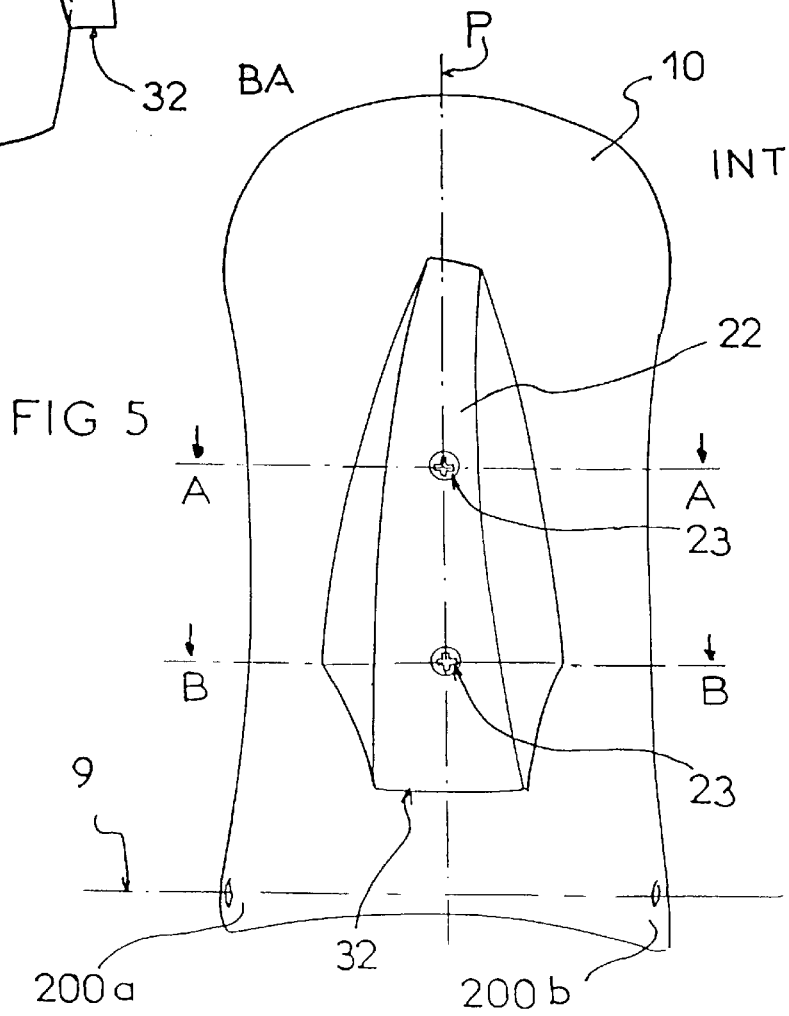
Figure 6:
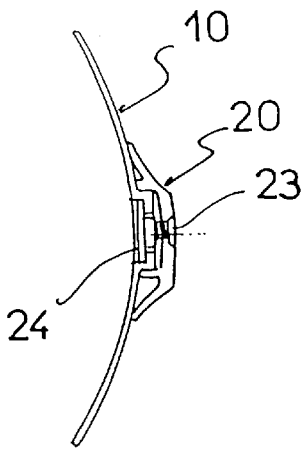
Figure 7:
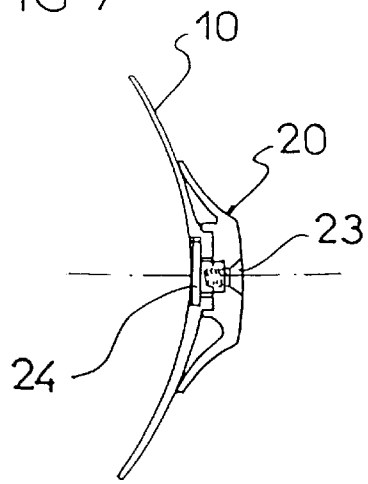
Figure 8:
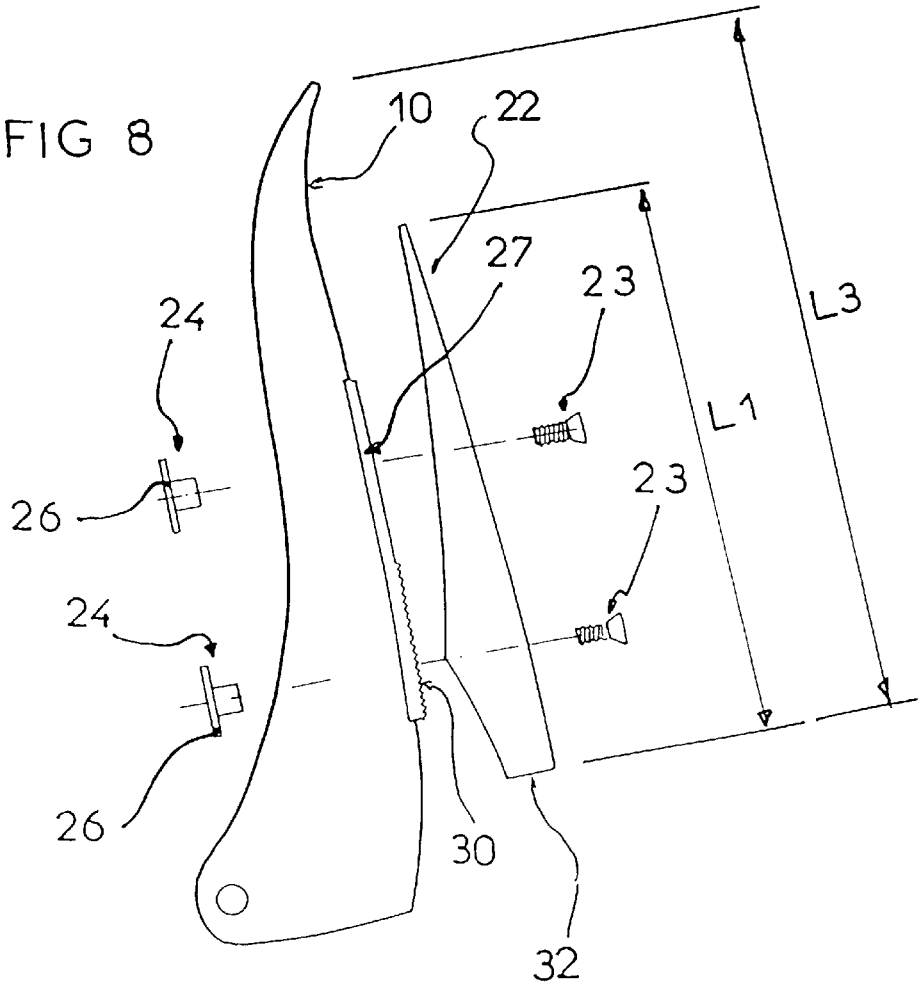
Figure 9:
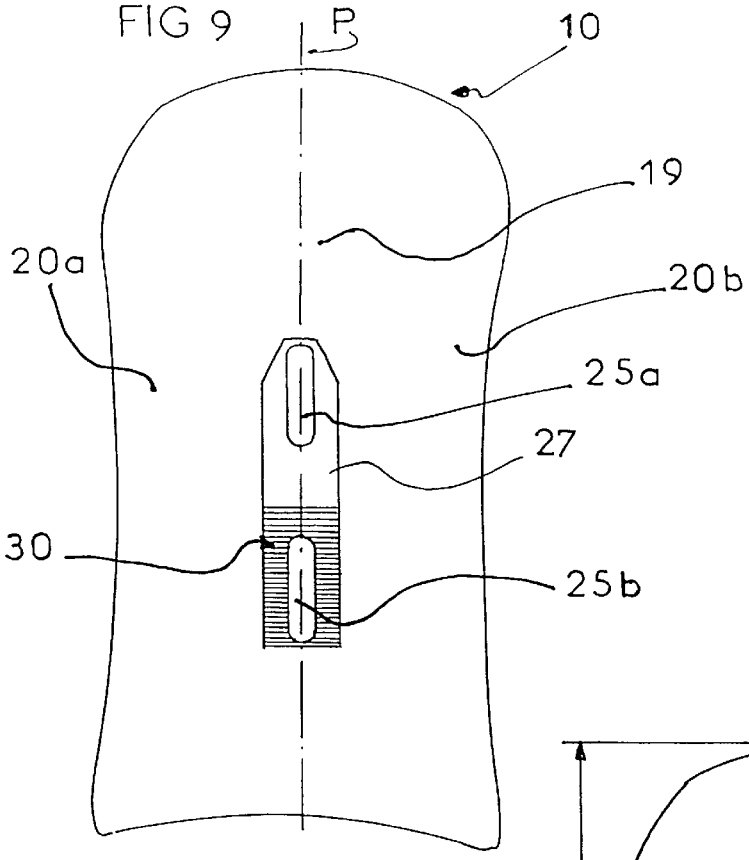
Figure 10:
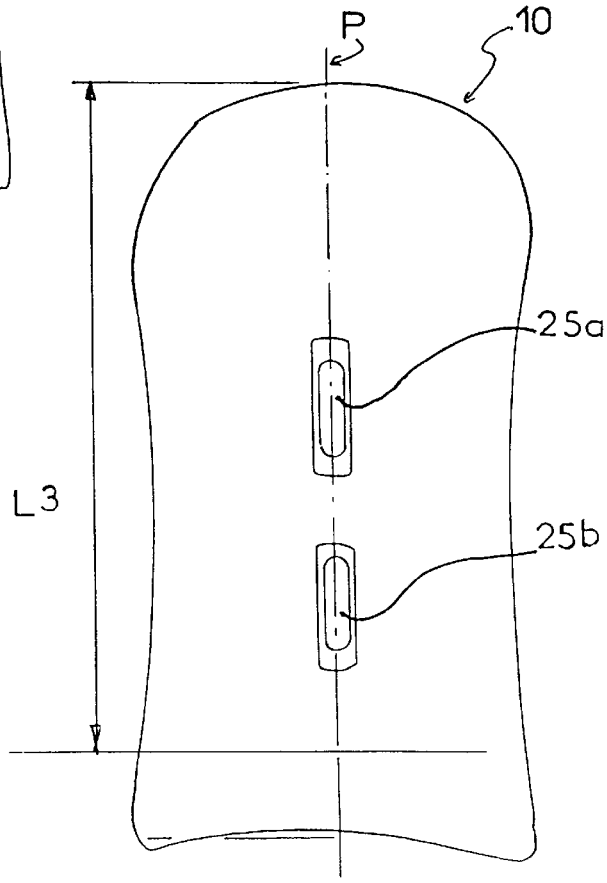
Figure 11:
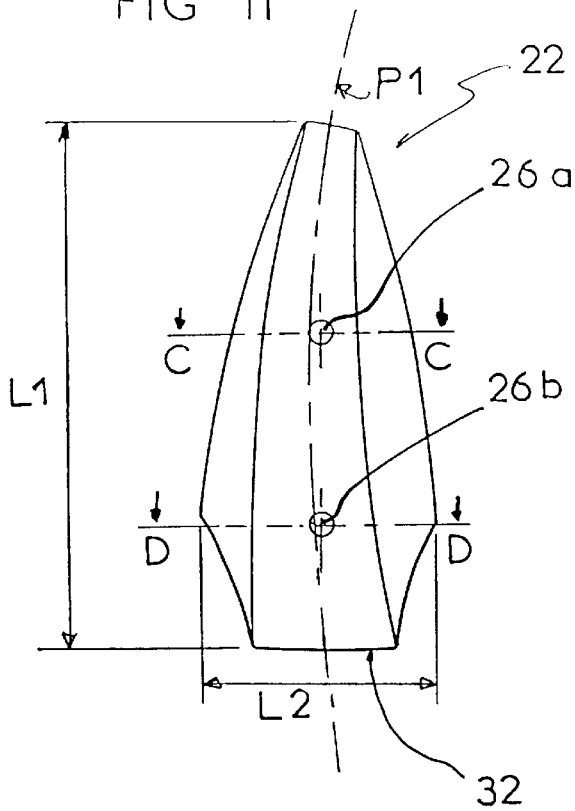
Figure 12:
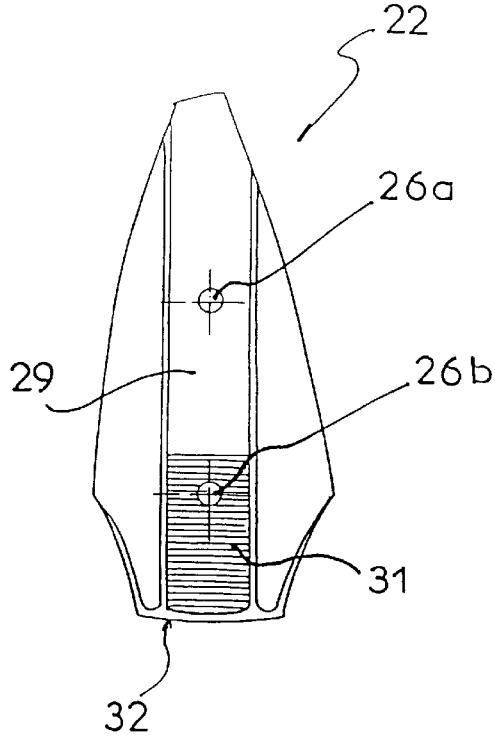
Figure 13:
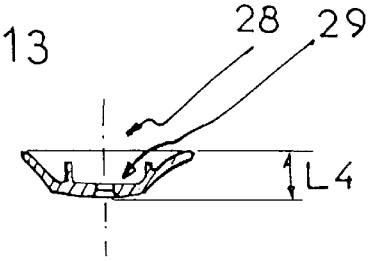
Figure 14:
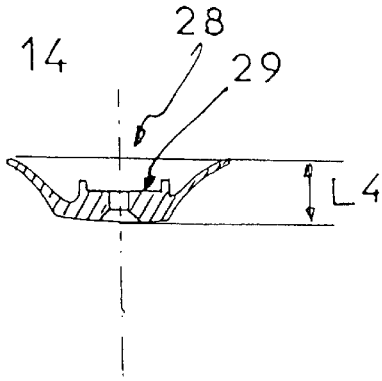

A snowboard is shown with two bindings 2*a*, 2*b*, also called mountings for keeping on the upper surface the two boots of the user. The two bindings are mounted on the upper surface across the snowboard with their plane of symmetry P disposed on the bias relative to an axis XX' along the board as is shown in FIG. 1.

Below is described the ski boot bindings 2*a*, 2*b*, that are designated under the common reference number 2.

FIGS. 1–14 show the binding 2 according to the invention that includes a base plate 4 that gives support extending horizontally from a front end 5 to a back end 6 at which a back piece 10 is mounted on the base plate.

The base plate 4 limits lateral displacement to each side by lateral sides 7*a*, 7*b*, including a left lateral side 7*a* and a right lateral side 7*b*. Each of the sides is advantageously made up by a vertical wall designed to retain the boot against lateral movement and to support retention means 16, 17. The two lateral sides are connected by an arcuate back 8. It is to be understood that at the rear, a back piece 10 is found, which back piece extends toward the top HA and is pivotally disposed on the lateral sides 7*a*, 7*b* on a transverse axis 9.

The ski boot 11 of the user has a relatively supple ankle support section 12 that extends upward from the bottom part 13 which extends from a front end 14 to a rear end 15 where a heel disposed toward the rear AR against the arcuate back 8.

The ski boot 11 according to the illustrated embodiment, is retained on the base plate 4 by a front retention mechanism 16 which holds the front of the ski boot and by a rear retention mechanism 17 which holds the ski boot at the top of the foot. The front holding mechanism 16 and the rear holding mechanism 17 preferably include an adjustment means for adapting their dimensions to the size of the ski boot. Of course, all other means of retention for the ski boot are also contemplated, others than those with flexible adjustable straps like, for example, without straps and notably of the type of automatic mounting and demounting mechanism known as "step in" such as are illustrated schematically in FIG. 24 and like, for example, those described in prior published French Patent No. 2,742,997. It will be noted that the rear piece 10 is designed to serve as a support piece at the back of the ankle support section 12 of the boot. To this end, the rear support piece 10 extends towards the top HA for holding the back 18 of the ankle section 12. The back piece 10 is advantageously formed with a central part 19 extending laterally between two lateral or horizontal parts 20*a*, 20*b*, one a left horizontal part 20*a* and one a right horizontal part 20*b*. The back piece 10 is articulated or pivoted relative to the base by lower ends 200*a*, 200*b* of each of the lateral sides 20*a*, 20*b* of the rear support piece 10 that is understood each of these has a hole 100 which receives, for example, a rivet 21 for attachment and pivoting. The rear piece 10 pivots relative to the base plate in a forward direction R1 and can, in the absence of a boot, be, for example, pivoted completely flat for transport.

Of course, it is important for the back ankle support piece to pivot on the base, but pivoting on the base by any other means of articulation is also contemplated like, for example, a resilient, deformable binding.

According to another characteristic of the invention, the ankle support includes on its central wall part 19 a reinforcement 22 which extends from the bottom to the top and conversely. It will be understood that by reinforcing the whole piece, the rigidity is improved and the resistance to the ankle support pieces deflecting rearward, insures the user of better ankle support while snowboarding while allows the user better control of his trajectory. The reinforcement 22 is, according to the invention, adjustable in vertical position relative to the ankle support piece. For this purpose, the aforementioned reinforcement is an independent, separate part from the ankle support 10 and is fixed in place by a means for adjusting and locking its vertical position. This means permits the user to adjust the vertical position of the reinforcement to a selected position relative to the ankle support piece 10 and to lock it in the selected position.

The locking and adjusting means includes at least a nut and screw or bolt system 23, 24 designed to lock the reinforcement 22 on the ankle support piece 10 and at least one oblong hole or adjusting slot 25*a*, 25*b* which permits the reinforcement to be moved vertically relative to the ankle support. Additionally, the framework of the invention includes other locking means such as, for example, those which do not require tools and in particular, a cam system or the like.

Thus, the ankle support piece 10 includes a vertical plane of symmetry P, the two slots 25*a*, 25*b* being disposed one above the other while the vertical reinforcement 22 includes two holes 26*a*, 26*b* disposed one above the other. Each of the holes 26*a*, 26*b* is designed to hold a screw or bolt 23 while each of the slots 25*a*, 25*b* is designed to hold a nut 24 that includes a flange or collet 26 to prevent rotation.

The reinforcement is a piece made out of plastic whose length L1 is longer than its width L2 while the length L1 is at least as high as half of the height L3 of the central wall part 19 of the ankle support piece 10 which is disposed near the back of the boot.

The invention's binding, in addition, includes a means to guide the vertical displacement of the reinforcement 22 relative to the ankle support piece 11. To this end, the ankle support piece 10 includes along the back of its central wall part 19, a rectangular vertical guide projection 27. While the reinforcement 22 includes a corresponding groove 29 which extends vertically and is designed to receive the aforementioned guidance projection. Thus, the reinforcement can be moved vertically by a vertical sliding motion along the guide track.

A means of indexing the position of the reinforcement includes a succession of cooperating teeth or detents. Thus, on the lower part of the guide track of the ankle support piece 10 are disposed a succession of teeth or detents 30 designed to cooperate with the corresponding teeth 31 arranged at the bottom of the groove 29 of the reinforcement 22.

In addition, the exterior cross-section of the reinforcement 22 can take various forms and can be constant or changing in form or dimension.

According to one preferred embodiment which is illustrated most clearly in FIGS. 4, 5, 11, 12, 13, and 14, the cross-section of the reinforcement varies by gradually decreasing in width L2 and thickness L4 toward the top.

In addition, the reinforcement section 22 is advantageously trapezoidal in shape.

According to another preferred embodiment, the reinforcement 22 is curved and the center of curvature of the curve extends along an inner face INT.

Of course, the reinforcement can have a rectangular or square section, even cylindrical. The dimensions can be constant or variable like those illustrated respectively in FIGS. 15, 16, 17, 18, 19, and 20.

Figure 15:
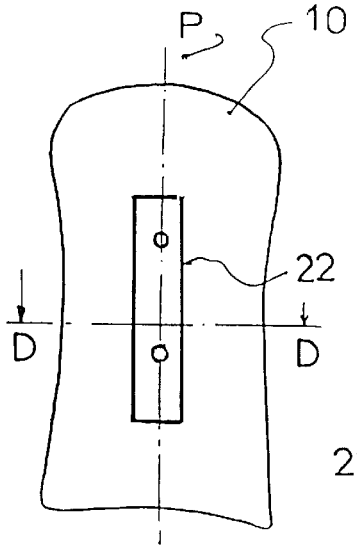
FIGS. 15–20 illustrate alternate embodiments of the back piece and its adjustable mounting plate.
Figure 15A:
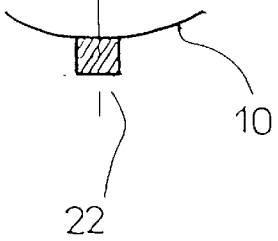
FIGS. 15*a*, 16*a*, 17*a*, 18*a*, 19*a*, and 20*a* are cross-sectional views through section D—D of the corresponding preceding Figures.

According to an alternate embodiment of FIGS. 15 and 15*a*, the shape of the reinforcement is square.

Figure 16:
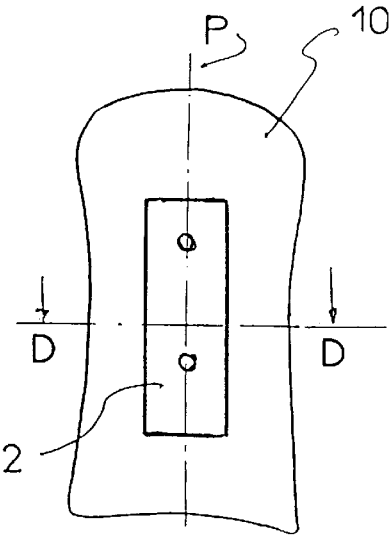
Figure 16A:
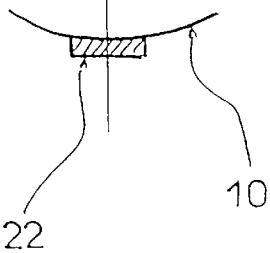

According to an alternate embodiment of FIGS. 16 and 16*a*, the shape of the reinforcement is rectangular.

Figure 17:
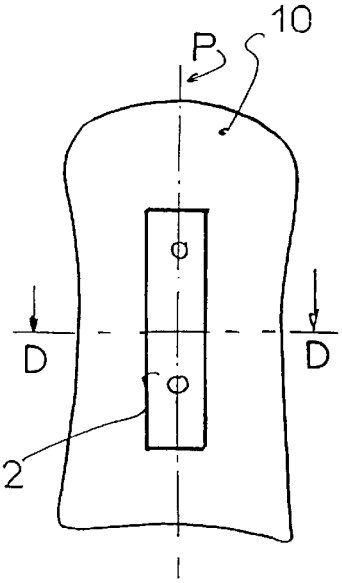
Figure 17A:
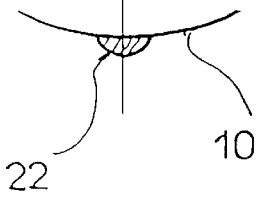

According to an alternate embodiment of FIGS. 17 and 17*a*, the shape of the reinforcement is semi-cylindrical.

Figure 18:
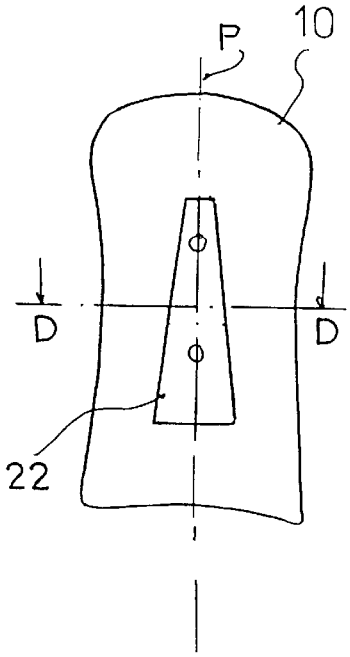
Figure 18A:
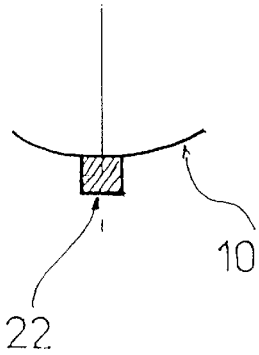

According to another alternate embodiment of FIGS. 18 and 18*a*, the shape of the reinforcement is square and its dimensions are progressively smaller toward the top.

Figure 19:
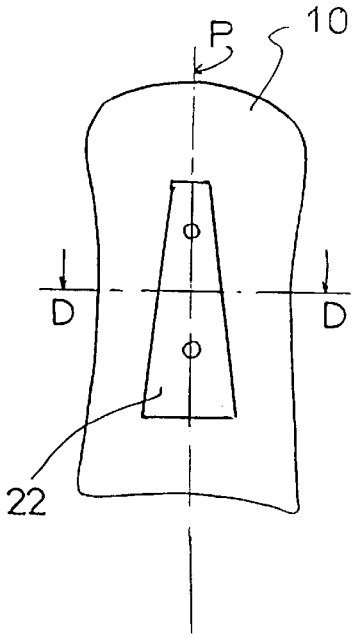
Figure 19A:
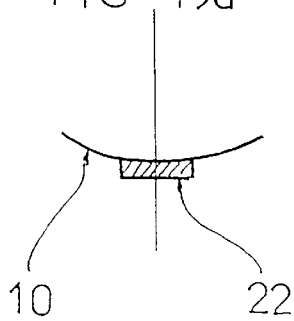

According to an alternate embodiment of FIGS. 19 and 19*a*, the shape of the reinforcement is rectangular and the dimensions are progressively smaller toward the top.

Figure 20:
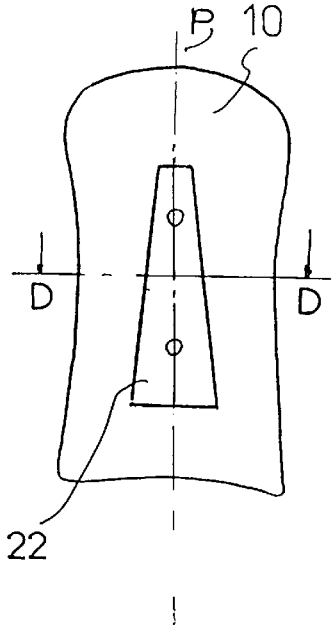
Figure 20A:
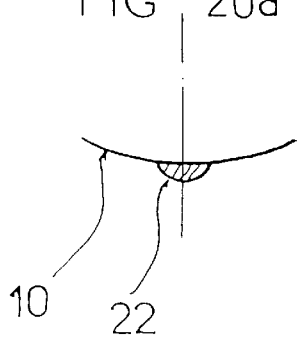

According to the alternate embodiment of FIGS. 20 and 20*a*, the cross-section of the reinforcement is semi-circular and the dimensions get progressively smaller toward the top.

Figure 21:
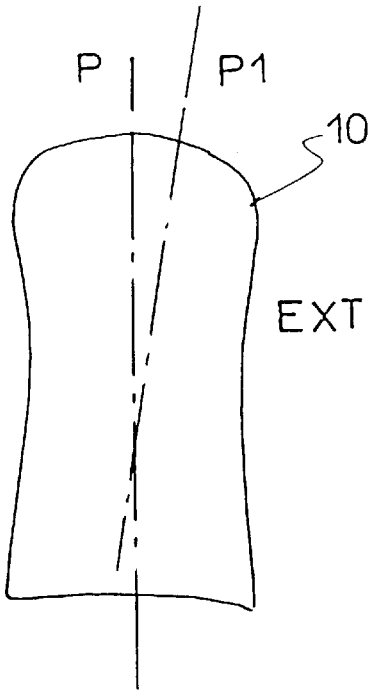
FIG. 21 is a schematic rear view of an alternate embodiment.

In addition, a general plane of symmetry P1 of the reinforcement can be in the general plane of symmetry P of the ankle support piece 10 such as shown in FIGS. 15–20. But, it can be different such as the alternative shown in FIG. 21.

According to this alternative embodiment, the general symmetry plane P1 of the reinforcement converges with the general symmetry plane P of the ankle support which can diverge toward the top and towards an inside face INT of the boot.

It is to be understood that due to the possibility of sliding motion of the reinforcement on the ankle support and the locking means, it is possible to readjust the reinforcement against the ankle support piece 10 either toward the top F1 or toward the bottom F2 to allow the user to adapt the stiffness of his needed ankle support. That is, the reinforcement and the means for adjusting and locking its vertical position function as a means for adjusting the stiffness of the ankle support piece.

In addition, the lower end 32 of the reinforcement defines a stop designed to rest against and be supported by an upper edge 33 of the rear arch 8. This stop system is designed to pivot towards the back of the ankle support which allows the user to have good rearward flexibility of the ankle support portion 12 of the boot. The position of the reinforcement being adjustable, the user can modify the angular position of his ankle support piece.

The reinforcement 22 can be of an identical or different material than that of the ankle support piece.

Figure 22:
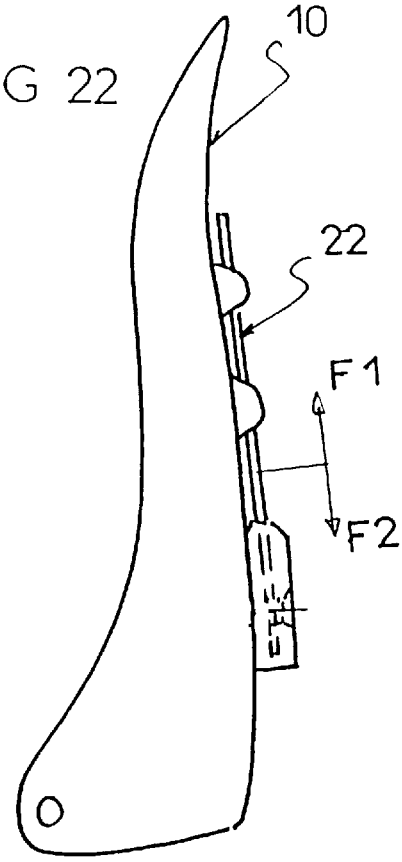
FIGS. 22 and 23 are similar views to FIGS. 4 and 5 which show another alternate embodiment.
Figure 23:
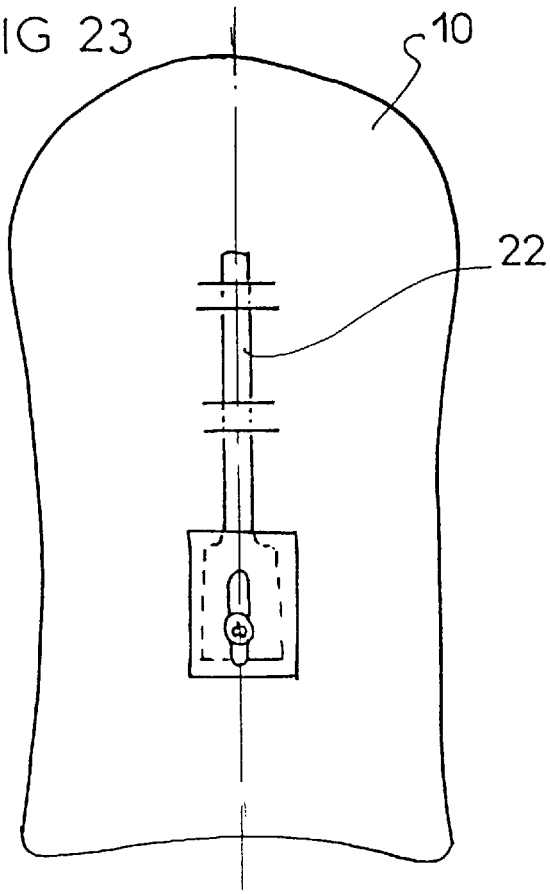

FIGS. 22 and 23 show another alternate embodiment in which the reinforcement is a small rail of composite material in an adjustable vertical position. It can be fixed to the ankle support by its ends while the remainder of its length can slide.

Figure 24:
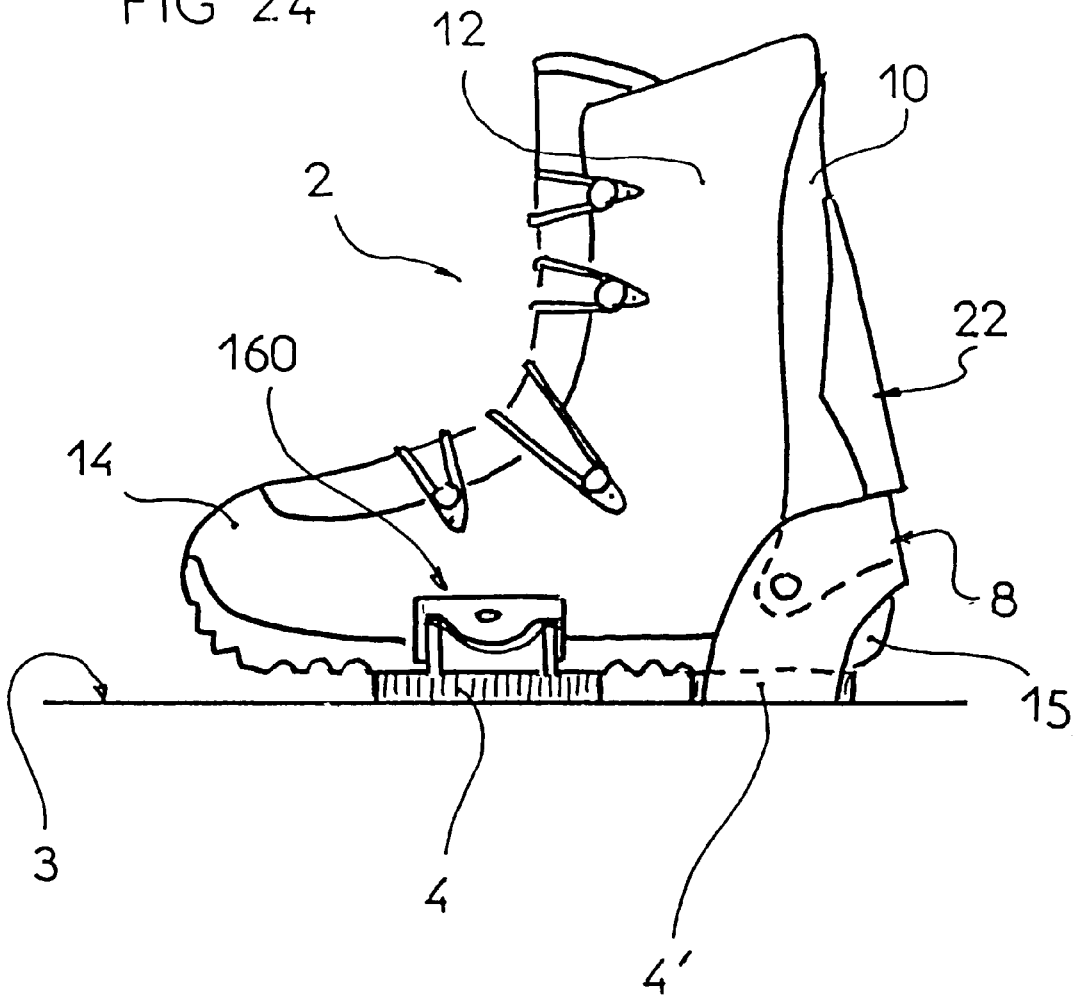
FIG. 24 is a view similar to FIG. 2 illustrating another embodiment of a means for mounting a ski boot.

FIG. 24 shows another means for attachment to the ski boot of a type in which the binding for the ski boot on the base 4 is not achieved by straps 16, 17 as described before, but a central device 160 like, for example, that described in prior French Patent No. 2,742,997. Thus, the back binding piece 10 is mounted on its own base 4' different from the base 4 of the ski boot binding.

Of course, the invention is not limited to the embodiments described and shown by way of example, but also includes all of the equivalent technologies and combinations thereof.

Having thus described the preferred embodiment, the invention is now claimed to be:

1. A ski boot binding for snowboards comprising:

a base;

a flexible back piece that extends upward at a rear of a boot to flexibly support the back of an ankle section of the boot;

a reinforcement adjustably mounted on a central wall portion of the back piece that is selectively adjustably and vertically positionable along the flexible back piece to adjustably reinforce the flexible back piece for adjustable rigidity and resistance to rearward deflection, the reinforcement disposed above the based and being a separate piece from the back piece and having a length that is longer than its width and a length that is at least half the height of the back piece.

2. The ski boot binding for snow boards as set forth in claim 1 wherein the back piece is disposed on the base plate.

3. The ski boot binding as set forth in claim 1 wherein the back piece is pivotally mounted on the base about a transverse axis.

4. The ski boot binding as set forth in claim 1 further including:

a means for adjusting and locking a vertical position of the reinforcement.

5. The ski boot binding as set forth in claim 4 wherein the means for adjusting and locking the vertical position of the reinforcement includes a nut/screw system for locking the reinforcement on the back piece and at least one oblong slot for enabling the reinforcement to be displaced longitudinally along the back piece.

6. A ski boot binding for snowboards comprising:

a base;

a back piece that extends upward to serve as a support for the back of an ankle section of the boot, the back piece including on a plane of general symmetry slots disposed one above the other;

a longitudinal reinforcement selectively and adjustably mounted on a central wall portion of the back piece for adjustable vertical positioning along the back piece, the longitudinal reinforcement including holes disposed one above the other;

a nut that includes a flange to block rotation of the nut, the nut being received in one of the slots; and a screw received through one of the holes and engaging the nut enabling the reinforcement to be longitudinally displaced and locked along the back piece.

7. The ski boot binding as set forth in claim 1 wherein the reinforcement is non-constant in transverse section.

8. The ski boot binding as set forth in claim 1 wherein a lower face of the reinforcement includes a rest which comes to be supported on an upper edge of an arcuate back separated from the base.

9. The ski boot binding for snowboards as set forth in claim 1 wherein the reinforcement is of the same material as the flexible back piece.

10. The ski book binding for snowboards as set forth in claim 1 wherein the reinforcement is fabricated from a different material from the back piece.

11. The ski boot binding as set forth in claim 6 further including:

a means for guiding the vertical displacement of the reinforcement along the back piece.

12. The ski boot binding as set forth in claim 7 wherein the transverse section of the reinforcement has a width which diminishes progressively towards the top.

13. The ski boot binding as set forth in claim 7 wherein the reinforcement is curved.

14. The ski boot binding as set forth in claim 11 wherein the back piece includes toward the rear of the central wall portion a vertical guide projection of rectangular section while on the front of the reinforcement there is a groove of corresponding profile that is disposed vertically for receiving the guide projection.

15. The ski boot binding as set forth in claim 12 wherein the reinforcement is trapezoidal in transverse section.

16. The ski boot binding as set forth in claim 14 further including:

a means for indexing a position of the reinforcement, which means includes a series of cooperating teeth.

17. The ski boot binding as set forth in claim 16 wherein the guide projection on the back piece includes a succession of horizontal teeth which cooperate with a succession of corresponding teeth disposed along the groove of the reinforcement.

18. A binding for snowboards comprising:

a rearwardly deflectable flexible ankle support piece which extends upward to support an ankle section of a boot and which flexes and deflects rearwardly;

a means for adjusting a stiffness and rearward direction of the flexible ankle support piece including:

a reinforcement element disposed above the base and having a vertical length that is longer than half of the vertical height of a central part of the flexible ankle support piece for restricting rearward deflection of the flexible ankle support piece; and, a means for selectively adjusting and locking a vertical position of the reinforcement element along the central part of the flexible ankle support piece for adjusting flexibility of the ankle support piece.

* * * * *